US006254406B1

(12) United States Patent
Chiu et al.

(10) Patent No.: US 6,254,406 B1
(45) Date of Patent: Jul. 3, 2001

(54) FLEXIBLE BOARD ELECTRICAL CONNECTOR WITH ROTATABLE COVER

(75) Inventors: Chin-Te Chiu; Rich Liu; Richard Huang; Cora Yang, all of Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 09/477,953

(22) Filed: Jan. 5, 2000

(30) Foreign Application Priority Data

Oct. 11, 1999 (TW) ..... 88217192

(51) Int. Cl.[7] ..... H01R 13/44
(52) U.S. Cl. ..... 439/142; 439/495; 439/260
(58) Field of Search ..... 439/142, 260, 439/259, 495, 496

(56) References Cited

U.S. PATENT DOCUMENTS 6,089,905 * 7/2000 Shimmyo et al. ..... 439/495

* cited by examiner

*Primary Examiner*—Paula Bradley
*Assistant Examiner*—Alexander Gilman
(74) *Attorney, Agent, or Firm*—Pitney, Hardin, Kipp & Szuch LLP

(57) ABSTRACT

A flexible board electrical connector includes a housing with two integral lower barb elements, and a front cover, which rotates on the housing between open and closed positions. Each of the lower barb elements has a vertical plate portion, and a lateral projection that extends laterally from an upper end of the vertical plate portion. When the cover is at the closed position, two retaining projections of the cover engage the lateral projections of the housing, thereby preventing upward removal of the retaining projections of the cover from the housing. The cover has two integral pivot pins on two end portions thereof, which are mounted respectively and rotatably within two accommodating spaces in the housing. Preferably, the housing further includes two integral upper barb elements, each of which has a horizontal plate portion, and a downward projection that extends downwardly from a front end of the horizontal plate portion into an inlet of a pivot accommodating space in the housing. The downward projections are shaped and positioned so that the pivot pins can pass through the downward projections into the accommodating spaces, thereby subsequently preventing removal of the pivot pins from the accommodating spaces.

5 Claims, 9 Drawing Sheets

FLEXIBLE BOARD ELECTRICAL CONNECTOR WITH ROTATABLE COVER

BACKGROUND OF THE INVENTION

1. Field of the Invention

This invention relates to a flexible board electrical connector with a rotatable cover, more particularly to a flexible board electrical connector, which includes a housing that is provided with a pair of barb elements for retaining a free side portion of the cover on the housing to ensure electrical contact between a flexible board and the contact elements of the housing when the cover is at a closed position.

2. Description of the Related Art

Referring to FIG. 1, a conventional flexible board electrical connector is shown to include a generally rectangular housing (30*a*), a plurality of contact elements (40*a*) (only one is shown for the sake of clarity), and a front cover (50*a*). The housing (30*a*) has an opening (301*a*) formed in an upper surface thereof, two pivot accommodating holes (302*a*) formed in two end surfaces of the housing (30*a*), and a longitudinal row of transverse support channels (303*a*) formed in the housing (30*a*) between the holes (302*a*). The contact elements (40*a*) are fitted respectively within the support channels (303*a*) in the housing (30*a*). The cover (50*a*) is generally U-shaped, and has two parallel swing arms (501*a*), each of which is formed integrally with an inwardly extending pivot pin (502*a*) that is inserted into a corresponding one of the pivot accommodating holes (302*a*) in the housing (30*a*), thereby mounting the cover (50*a*) rotatably on the housing (30*a*). As such, the cover (50*a*) can rotate relative to the housing (30*a*) between an open position, where a flexible board (not shown) can be inserted into a space between the housing (30*a*) and the cover (50*a*), and a closed position, where the cover (50*a*) presses the flexible board (not shown) against the contact elements (40*a*). However, the cover (50*a*) cannot be retained effectively at the closed position. Furthermore, the cover (50*a*) may separate untimely and undesirably from the housing (30*a*).

SUMMARY OF THE INVENTION

An object of this invention is to provide a flexible board electrical connector, in which a cover can be retained effectively at a closed position relative to a housing, thereby securing electrical contact between a flexible board and a plurality of contact elements.

Another object of this invention is to provide a flexible board electrical connector, in which a cover can be retained effectively on a housing, thereby preventing removal of the cover from the housing during rotation of the cover relative to the housing.

According to this invention, a flexible board electrical connector includes a housing with two integral lower barb elements, and a front cover, which rotates on the housing between open and closed positions. Each of the lower barb elements has a vertical plate portion, and a lateral projection that extends laterally from an upper end of the vertical plate portion. When the cover is at the closed position, two retaining projections of the cover engage the lateral projections of the housing, thereby preventing upward removal of the retaining projections of the cover from the housing. The cover has two integral pivot pins on two end portions thereof, which are mounted respectively and rotatably in two accommodating spaces in the housing. Preferably, the housing further includes two integral upper barb elements, each of which has a horizontal plate portion, and a downward projection that extends downwardly from a front end of the horizontal plate portion into an inlet of a pivot accommodating space in the housing. The downward projections are shaped and positioned so that the pivot pins can pass through the downward projections into the accommodating spaces, thereby subsequently preventing removal of the pivot pins from the accommodating spaces.

BRIEF DESCRIPTION OF THE DRAWINGS

These and other features and advantages of the invention will become apparent in the following detailed description of two preferred embodiments, with reference to the accompanying drawing, in which.

DETAILED DESCRIPTION OF THE PREFERRED EMBODIMENTS

Figure 1:
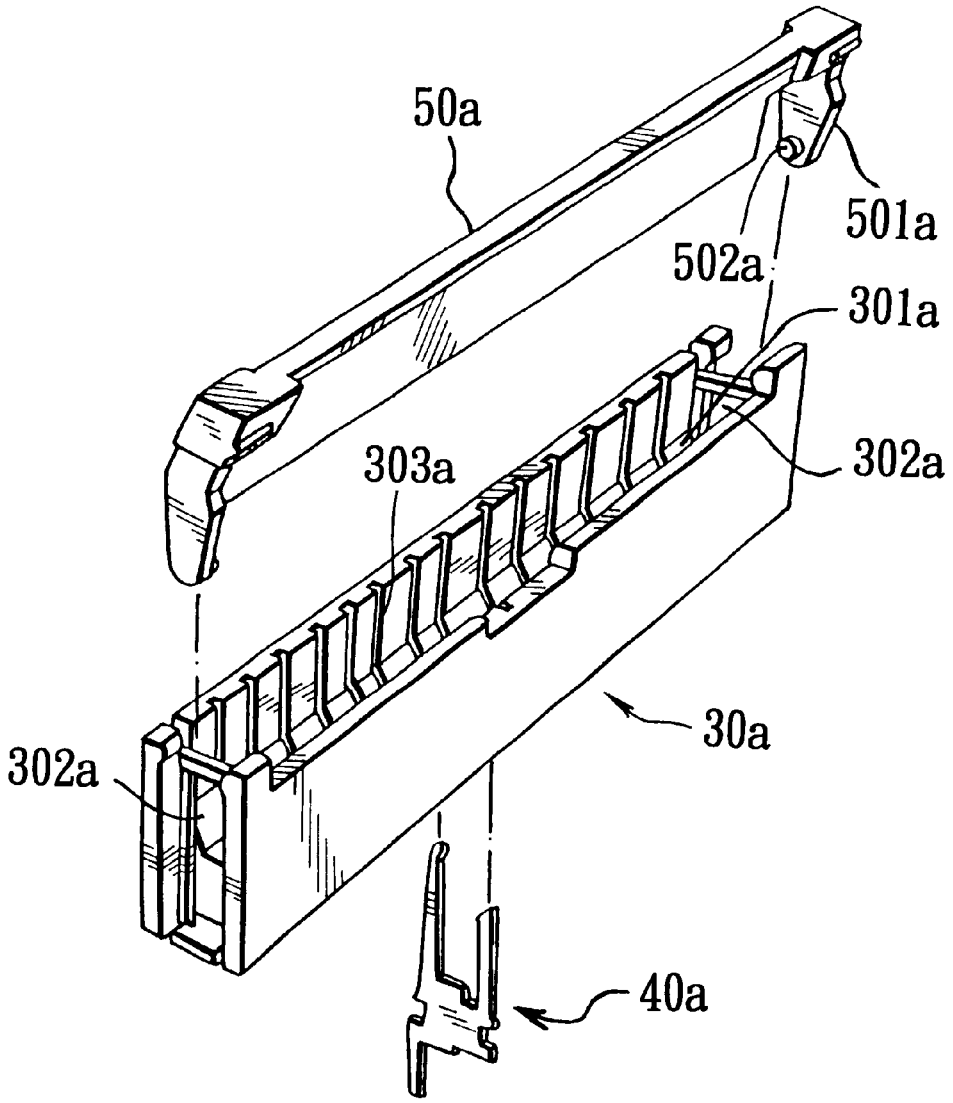
FIG. 1 PRIOR ART
FIG. 1 is an exploded perspective view of a conventional flexible board electrical connector.
Figure 2:
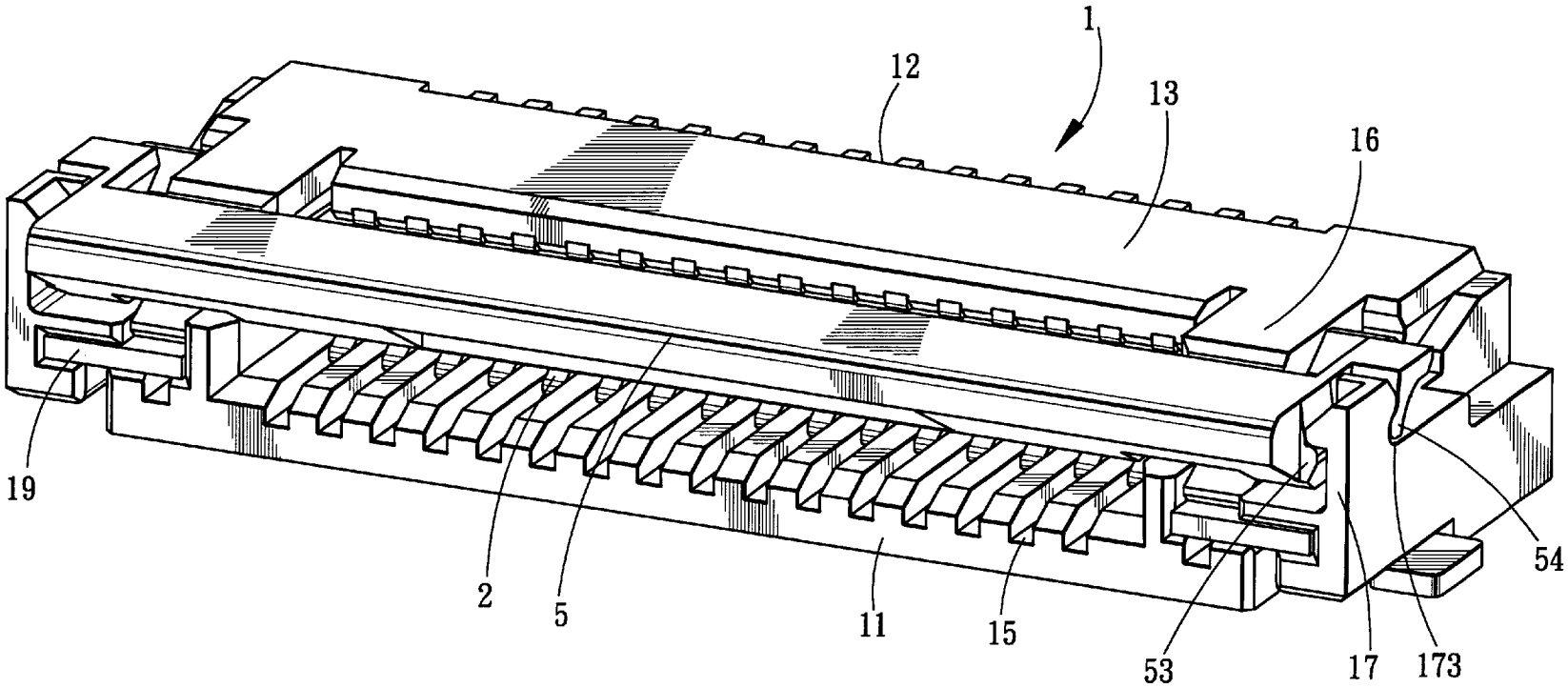
FIG. 2 is an assembled perspective view of a first preferred embodiment of a flexible board electrical connector according to this invention.
Figure 3:
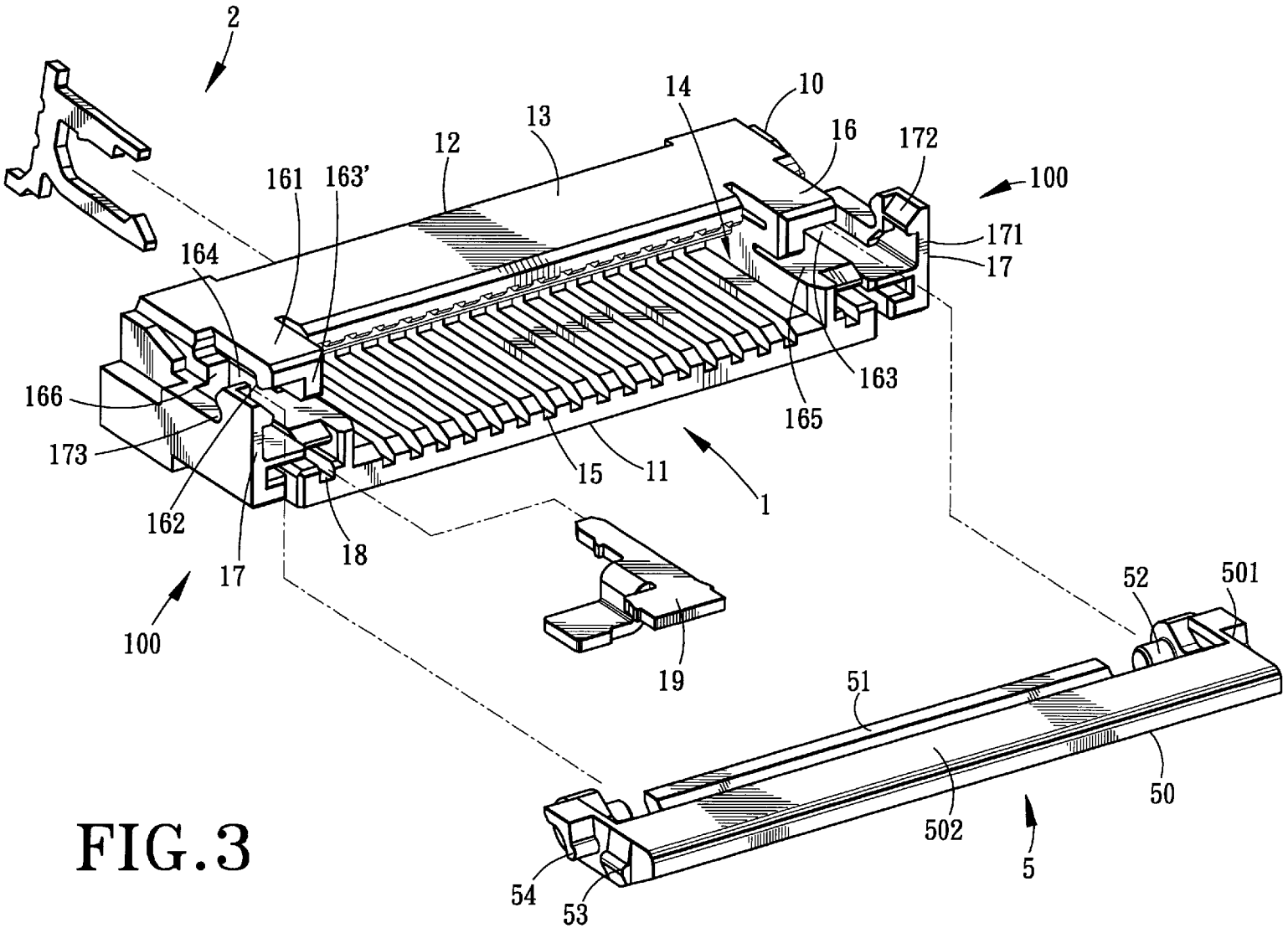
FIG. 3 is an exploded perspective view of the first preferred embodiment.

Referring to FIGS. 2 and 3, a first preferred embodiment of a flexible board electrical connector according to this invention is shown to include a generally rectangular housing 1, a plurality of contact elements 2 (only one is shown for the sake of clarity), and a front cover 5.

The housing 1 includes an elongated housing body 10 having a front side 11 and a rear side 12, and a pair of support members 100 that are formed respectively and integrally on two end portions of the housing body 10. The housing body 10 has an elongated top surface 13, which is formed with a longitudinal opening 14 along the front side 11 of the housing body 10. A longitudinal row of support channels 15 are formed transversely in the housing body 10, and are located between the support members 100. Each of the support members 100 includes an upper barb element 16, which has a horizontal plate portion 161 that projects integrally from the housing body 10, and a downward projection 162 that projects integrally and downwardly from a front end of the horizontal plate portion 161 into an inlet 163 of a pivot accommodating space 164. Each of the pivot accommodating spaces 164 is defined between the horizontal plate portion 161 of a corresponding one of the upper barb elements 16 and a platform 165 of the housing body 10, and between the downward projection 162 of a corresponding one of the upper barb elements 16 and a vertical rear wall 166 of the housing body 10. Each of the supporting members 100 further includes a lower barb element 17, which is located below the upper barb elements 16 and which has a vertical plate portion 171 that is formed integrally with the housing body 10, and a lateral projection 172 that projects laterally and inwardly from an upper end of the vertical plate portion 171. Two ground elements 19 (only one is shown) are disposed respectively within two transverse side channels 18 in the housing body 10 in a known manner for electrical connection with a printed circuit board (not shown) on which the housing 1 is fixed.

The contact elements 2 are fitted respectively within the support channels 15 and in the opening 14 in the housing body 10.

Figure 4:
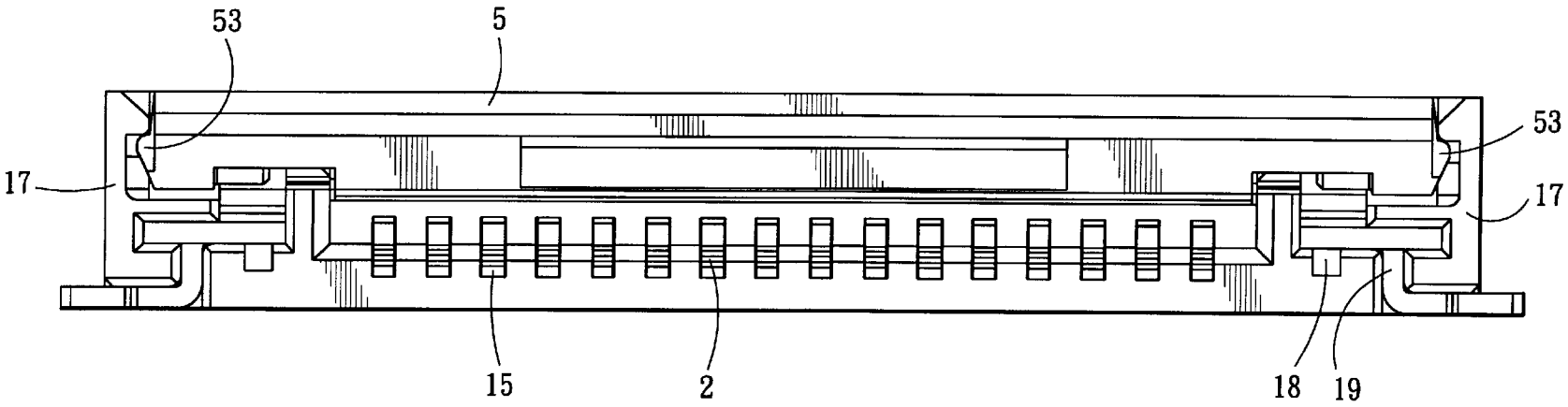
FIG. 4 is a schematic front view illustrating how upward removal of a free side portion of a cover from a housing of the first preferred embodiment is prevented.
Figure 5:
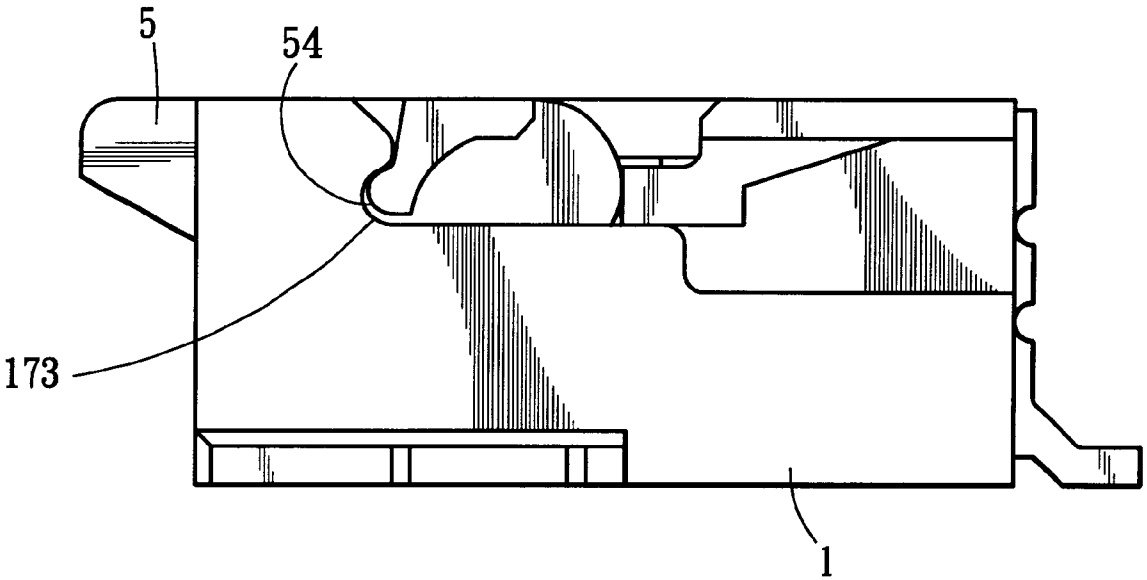
FIG. 5 is a schematic side view illustrating how forward removal of the free side portion of the cover from the housing of the first preferred embodiment is prevented.

The front cover 5 is unitary, and has an elongated cover body 50, a pressing strip 51, two longitudinal pivot pins 52, two retaining projections 53, and two rounded engagement edges 54. The cover body 50 is U-shaped, and has two parallel swing arms 501 and a covering strip 502 that interconnects the swing arms 501. The pressing strip 51 is formed on the covering strip 502. The pivot pins 52 extend respectively and inwardly from the swing arms 501, and are confined respectively within the pivot accommodating spaces 164 in the housing 1. As such, the covering strip 502 acts as a free side portion of the cover body 50. The retaining projections 53 project respectively and outwardly from two end portions of the covering strip 502 of the cover body 50. The engagement edges 54 are formed respectively on the end portions of the cover body 50 near the retaining projections 53. The downward projections 162 are shaped and located so that the pivot pins 52 of the front cover 5 can pass through the downward projections 162 into the pivot accommodating spaces 164 in the housing 1, thereby subsequently preventing removal of the pivot pins 52 from the pivot accommodating spaces 164. The front cover 5 rotates between a closed position as shown in FIGS. 4 and 5, where the covering strip 502 of the cover 5 covers the opening 14 in the housing 1, and an open position, where a flexible board (not shown) can be inserted into the pressing strip 51 of the cover 5 and the contact elements 2. When the cover 5 is at the closed position, the retaining projections 53 of the cover 5 engage respectively the lateral projections 172 of the housing 1 for preventing upward removal of the retaining projections 53 of the cover 5 from the housing 1. Accordingly, the pressing strip 51 of the cover 5 presses the flexible board (not shown) against the contact elements 2. In this situation, the retaining projections 53 of the cover 5 can be removed forcibly and upwardly from the lateral projections 172 of the lower barb elements 17. When the cover 5 is at the open position, the retaining projections 53 of the cover 5 are turned upwardly to separate from the lateral projections 172 of the lower barb elements 17.

Each of the upper barb elements 16 is formed with a vertical side wall 163', which extends downwardly from an inner side of the horizontal plate portion 161 and which is located between the pressing strip 51 and a corresponding one of the pivot pins 52 of the cover 5. Each of the swing arms 501 of the cover 5 is retained between the vertical side wall 163' of a corresponding one of the upper barb elements 16 and a corresponding one of the lower barb elements 17. Each of the lower barb elements 17 has a rear side wall, which is formed with a generally semicircular recess 173 that engages a corresponding one of the engagement edges 54 of the cover 5 when the cover 5 is at the closed position, thereby preventing forward removal of the retaining projections 53 of the cover 5 from the housing 1.

Figure 6:
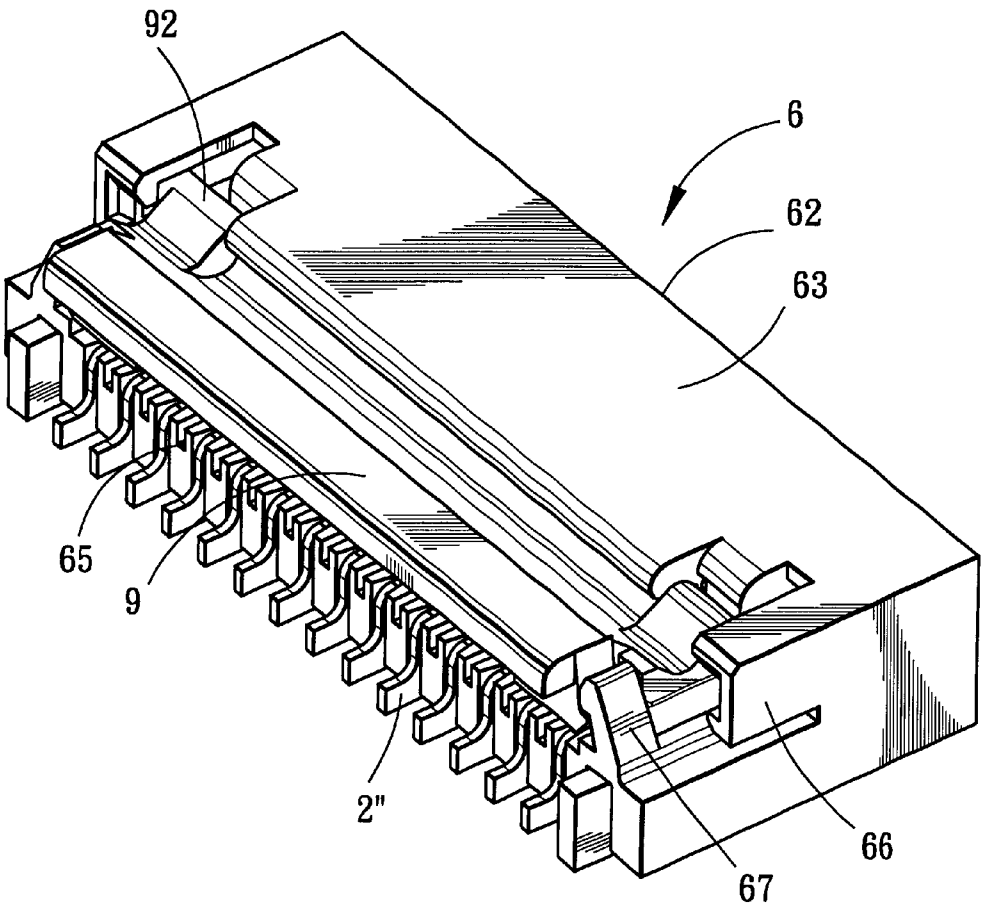
FIG. 6 is an assembled perspective view of a second preferred embodiment of a flexible board electrical connector according to this invention.
Figure 7:
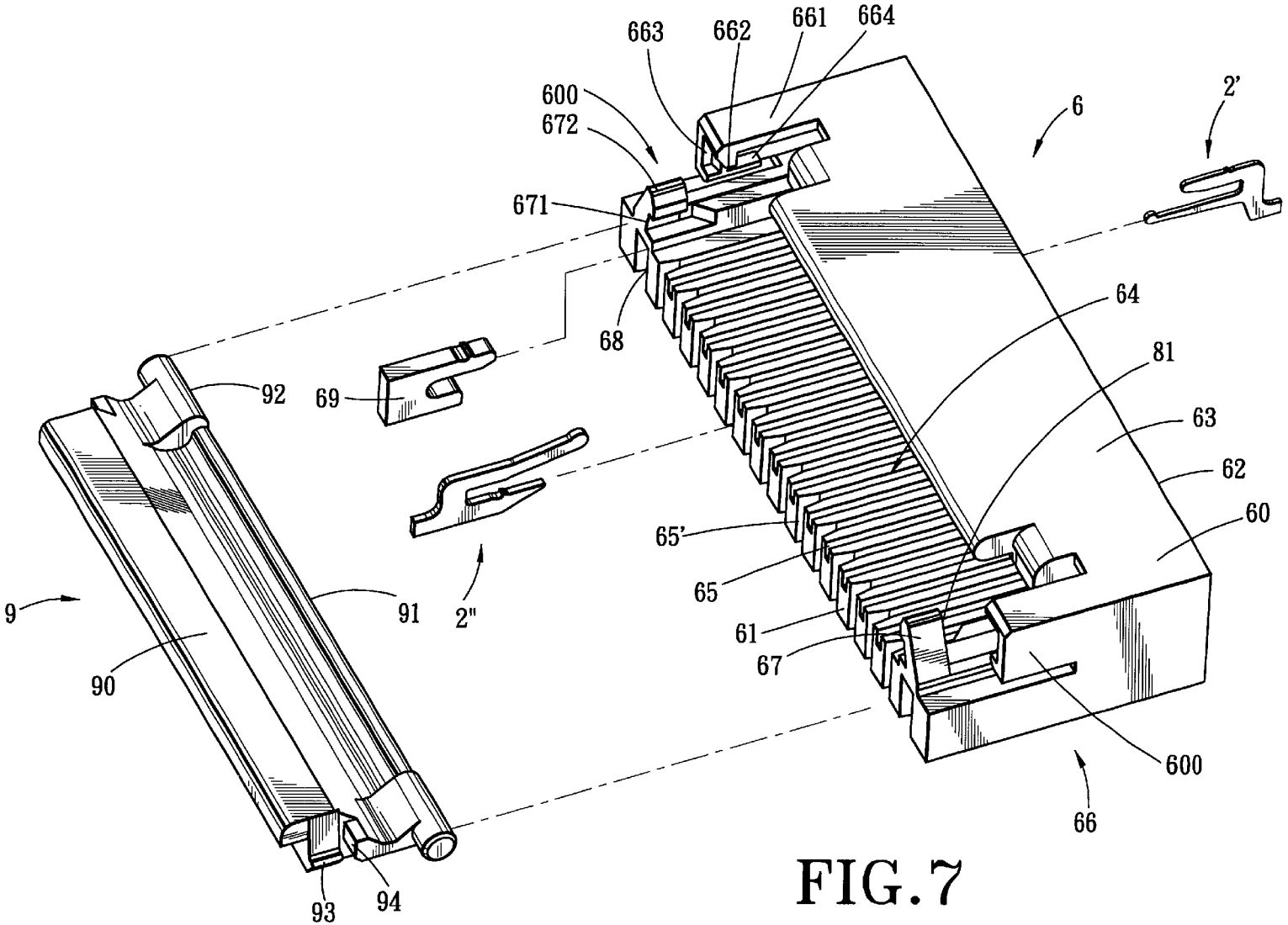
FIG. 7 is an exploded view of the second preferred embodiment.

Referring to FIGS. 6 and 7, a second preferred embodiment of a flexible board electrical connector according to this invention is shown to include a generally rectangular housing 6, a plurality of first contact elements 2' (only one is shown for the sake of clarity), a plurality of second contact elements 2" (only one is shown for the sake of clarity),and a front cover 9.

The housing 6 includes an elongated housing body 60 having a front side 61 and a rear side 62, and a pair of support members 600 that are formed respectively and integrally on two end portions of the housing body 60. The housing body 60 has an elongated top surface 63, which is formed with a longitudinal opening 64 along the front side 62 of the housing body 60. A longitudinal row of first support channels 65 and second support channels 65' are formed transversely in the housing body 60, and are located between the support members 600. Each of the support members 600 includes an upper barb element 66, which has a horizontal plate portion 661 that projects integrally from the housing body 60, and a downward projection 662 that projects integrally and downwardly from a front end of the horizontal plate portion 661 into an inlet 663 of a pivot accommodating space 664 for performing the same function as that of the first embodiment. Each of the pivot accommodating spaces 664 is defined between the horizontal plate portion 661 of a corresponding one of the upper barb elements 66 and a horizontal bottom wall 665, which is formed integrally with a lower end of a vertical side wall 666 that extends integrally and downwardly from an outer side of the horizontal plate portion 661 of a corresponding one of the upper barb elements 66.

Each of the supporting members 600 further includes a lower barb element 67, which is located below the upper barb elements 66 and which has a vertical plate portion 671 that is formed integrally with the housing body 60, and a lateral projection 672 that projects laterally and inwardly from an upper end of the vertical plate portion 671. Two ground elements 69 (only one is shown) are disposed respectively within two transverse side channels 68 in the housing body 60 in a known manner for electrical connection with a printed circuit board (not shown), on which the housing 6 is fixed.

The first and second contact elements 2', 2" are fitted respectively within the support channels 65 and in the opening 64 in the housing body 60.

Figure 8:
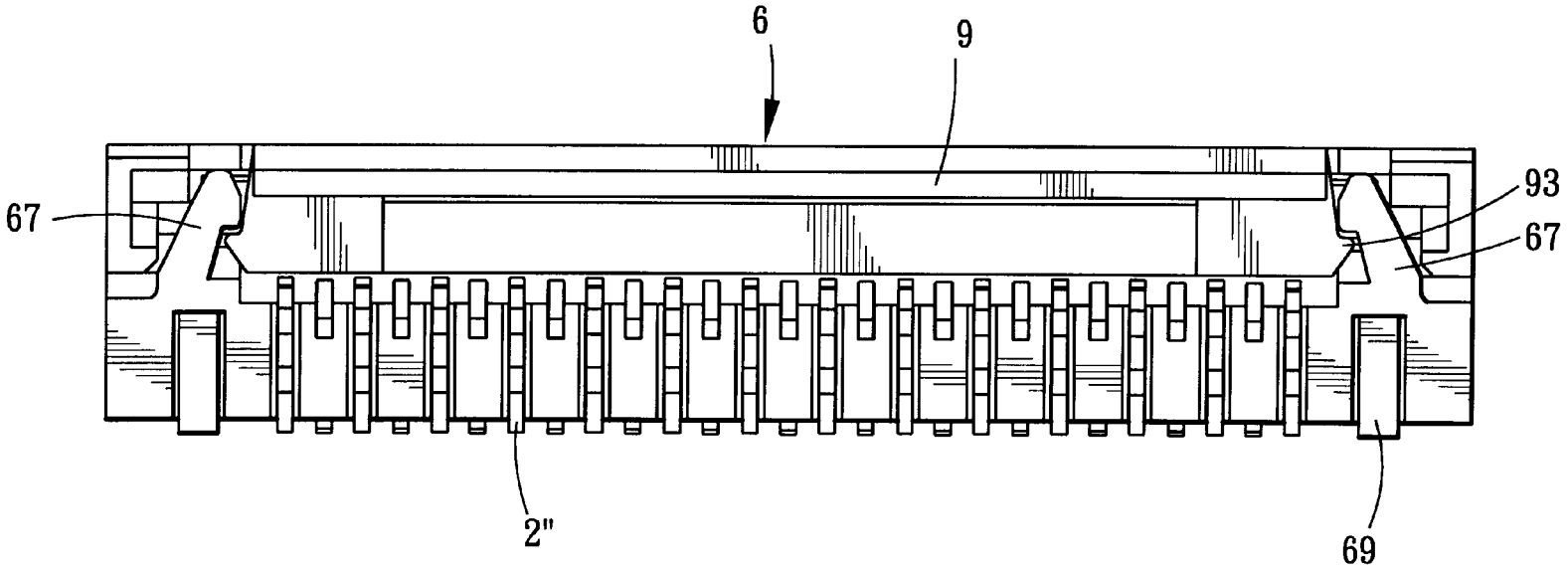
FIG. 8 is a schematic side view illustrating how removal of a free side portion of a cover from a housing of the second preferred embodiment is prevented.
Figure 9:
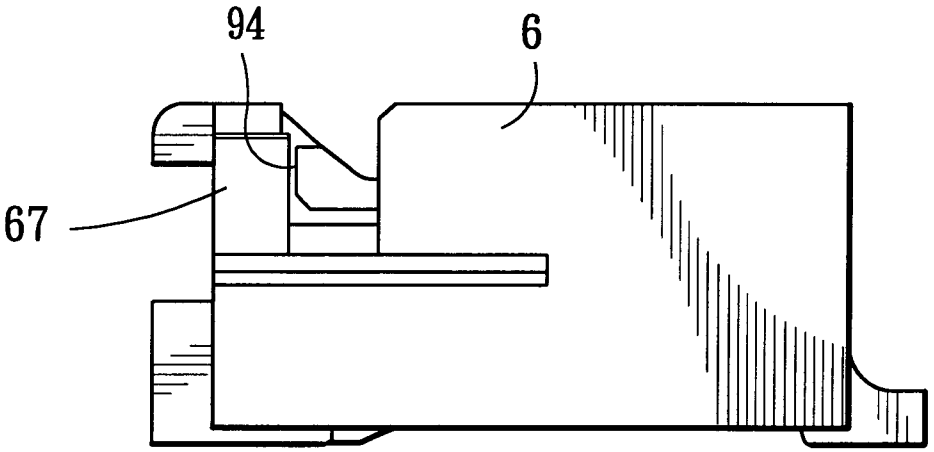
FIG. 9 is another schematic side view illustrating how forward removal of the free side portion of the cover from the housing of the second preferred embodiment is prevented.

The front cover 9 is unitary, and has an elongated cover body 90, a pressing side 91, two longitudinal pivot pins 92, two retaining projections 93, and two stop walls 94. The pivot pins 92 extend respectively and outwardly from two ends of the cover body 90, and are confined respectively within the pivot accommodating spaces 664 in the housing 6. The retaining projections 93 project respectively and outwardly from two end portions of a free side portion of the cover body 90. The stop walls 94 are formed respectively on the end portions of the cover body 90 near the retaining projections 93. The downward projections 662 are shaped and located so that the pivot pins 92 of the front cover 9 can pass through the downward projections 662 into the pivot accommodating spaces 664 in the housing 6, thereby subsequently preventing removal of the pivot pins 92 from the pivot accommodating spaces 664. The front cover 9 rotates between a closed position as shown in FIGS. 8 and 9, where the cover 9 covers the opening 64 in the housing 6, and an open position, where a flexible board (not shown) can be inserted into the pressing side 91 of the cover 9 and the contact elements 2', 2". When the cover 9 is at the closed position, the retaining projections 93 of the cover 9 engage respectively the lateral projections 672 of the housing 1 for preventing upward removal of the retaining projections 93 of the cover 9 from the housing 6. Accordingly, the pressing side 91 of the cover 9 can press effectively the flexible board (not shown) against the contact elements 2', 2". In this situation, the retaining projections 93 of the cover 9 can be removed forcibly and upwardly from the lateral projections 672 of the lower barb elements 67. When the cover 9 is at the open position, the retaining projections 93 of the cover 9 are turned upwardly to separate from the lateral projections 672 of the lower barb elements 67.

Referring to FIG. 9, when the cover 9 (see FIG. 7) is at the closed position, the stop walls 94 of the cover 9 (see FIG. 7) are located immediately behind the lower barb elements 67, thereby preventing forward removal of the retaining projections 93 (see FIG. 7) of the cover 9 (see FIG. 7) from the housing 6.

With this invention thus explained, it is apparent that various modifications and variations can be made without departing from the spirit and scope of this invention. It is therefore intended that this invention be limited only as indicated by the appended claims.

We claim:

1. A flexible board electrical connector comprising;

a generally rectangular housing including an elongated housing body having a front side and a rear side, a pair of support members that are formed respectively and integrally on two end portions of said housing body, and a longitudinal row of support channels that are formed transversely in said housing body and that are located between said support members, said housing body having an elongated top surface, which is formed with a longitudinal opening along said front side of said housing body, each of said support members having a pivot accommodating space formed therein, and a lower barb element, which has a vertical plate portion that is formed integrally with said housing body, and a lateral projection that projects laterally and inwardly from an upper end of said vertical plate portion;

a plurality of contact elements fitted respectively within said support channels in said opening;

two ground elements attached to said housing; and a front cover having an elongated cover body, two longitudinal pivot pins that are formed respectively and integrally on two end portions of said cover body and that are aligned with each other, and two retaining projections that project respectively and outwardly from two end portions of said cover body, said pivot pins being confined respectively within said pivot accommodating spaces in said support members of said housing in such a manner that said front cover is rotatable between a closed position, where said retaining projections of said front cover engage respectively said lateral projections of said lower barb elements of said housing for preventing upward removal of said retaining projections of said front cover from said housing and where said retaining projections of said front cover can be removed forcibly and upwardly from said lateral projections of said lower barb elements of said housing, and an open position, where said retaining projections of said front cover separate from said lateral projections of said lower barb elements of said housing;

wherein each of said pivot accommodating spaces in said support members has an inlet, each of said support members of said housing including an upper barb element, which is located above said lower barb elements and which has a horizontal plate portion that projects integrally from said housing body and that has a front end, and a downward projection that projects integrally and downwardly from said front end of said horizontal plate portion into said inlet of a corresponding one of said pivot accommodating spaces in said support members, said downward projections being shaped and located so that said pivot pins of said front cover can pass through said downward projections into said pivot accommodating spaces in said housing, thereby subsequently preventing removal of said pivot pins from said pivot accommodating spaces.

2. A flexible board electrical connector as claimed in claim 1, wherein said horizontal plate portion of each of said upper barb elements has an inner side and an outer side, and is formed integrally with a vertical side wall that extends downwardly from said inner side of said horizontal plate portion, said housing body having two platforms that are located respectively on said two end portions of said housing body under said upper barb elements, and two vertical rear walls that are formed respectively on said platforms, each of said pivot accommodating spaces being defined between said horizontal plate portion of a corresponding one of said upper barb elements and a corresponding one of said platforms, and between a corresponding one of said rear walls and a corresponding one of said downward projections, said cover body being U-shaped and having two parallel swing arms, each of which is retained between said vertical side wall of a corresponding one of said upper barb elements and a corresponding one of said lower barb elements, and a covering strip that interconnects said swing arms and that covers said opening in said housing when said front cover is at said closed position, said pivot pins extending respectively and inwardly from said swing arms.

3. A flexible board electrical connector as claimed in claim 2, wherein each of said lower barb elements has a rear side wall, which is formed with a generally semicircular recess, said end portions of said front cover being formed respectively and integrally with two rounded engagement edges, which engage respectively said recesses in said lower barb elements when said front cover is at said closed position, thereby preventing forward removal of said retaining projections of said front cover from said housing.

4. A flexible board electrical connector as claimed in claim 1, wherein said horizontal plate portion of each of said upper barb elements has an inner side and an outer side, and is formed integrally with a vertical side wall that extends downwardly from said outer side of said horizontal plate portion, and a horizontal bottom wall that extends from a lower end of said vertical side wall and that is located under said horizontal plate portion, thereby defining a corresponding one of said pivot accommodating spaces among said horizontal plate portion, said bottom wall, and said vertical side wall, said pivot pins extending respectively and outwardly from two ends of said cover body.

5. A flexible board electrical connector as claimed in claim 4, wherein said cover body is formed integrally with two stop walls that are adjacent to said retaining projections of said cover, respectively, and that are located immediately behind said lower barb elements of said housing when said cover is at said closed position, thereby preventing forward removal of said retaining projections of said cover from said accommodating spaces.

* * * * *